United States Patent [19]

Kreibaum

[11] 4,324,277

[45] Apr. 13, 1982

[54] METHOD FOR PROCESSING ROUND LUMBER INTO CUT LUMBER

[76] Inventor: Otto Kreibaum, 7 Ortsteil Thuste, 3216 Salzhemmendorf, Fed. Rep. of Germany

[21] Appl. No.: 150,304

[22] Filed: May 16, 1980

[30] Foreign Application Priority Data

May 21, 1979 [DE] Fed. Rep. of Germany ..... 2920543

[51] Int. Cl.[3] ..... B27C 9/04

[52] U.S. Cl. ..... 144/312; 144/326 R

[58] Field of Search ..... 144/3 R, 326 R, 312, 144/39, 41

[56] References Cited

U.S. PATENT DOCUMENTS

| | | | |
|---|---|---|---|
| 3,259,157 | 7/1966 | Runnion | 144/3 R |
| 3,304,971 | 2/1967 | Pease | 144/312 |
| 3,313,329 | 4/1967 | Mitten | 144/312 |
| 3,457,978 | 7/1969 | Ahlstedt | 144/312 |
| 3,459,246 | 8/1969 | Ohosson | 144/312 |
| 3,487,866 | 1/1970 | Mitten | 144/312 |
| 3,738,404 | 6/1973 | Walker | 144/39 |
| 3,934,630 | 1/1976 | Cockle | 144/39 |
| 4,239,069 | 12/1980 | Zimmerman | 144/39 |

*Primary Examiner*—W. D. Bray

*Attorney, Agent, or Firm*—Prutzman, Kalb, Chilton & Alix

[57] ABSTRACT

A method of producing heart planks and slabs from logs including cutting edge profiles of the slabs to be cut and then cutting the slab to separate it from the central heart plank.

4 Claims, 6 Drawing Figures

METHOD FOR PROCESSING ROUND LUMBER INTO CUT LUMBER

Figure 1:
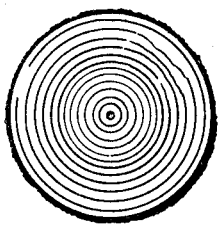

The present invention relates to a method for processing cylindrically cut round lumber into cut lumber, in which method slabs are produced in addition to heart planks, which slabs are, on the inside, delimited by a straight cut and, on the outside, at least on the periphery close to the edge, are delimited by the delimitation of the round lumber having the shape of a circular arc and which feature on the edges an edge profile which deviates from the said boundary lines. Furthermore, the invention relates to a device for carrying out this method, which device features at least one saw for separating the slabs from the heart planks.

So far, in the production of cut lumber from round lumber, in the main only the heart area was utilized for the production of cut lumber while the partly round slabs are processed into chips for being processed further into chip boards. The possibilities for the direct utilization of the slabs are slight due to the difficulties caused by the circular cross-sectional delimitation and are only of a secondary kind. It is true that it is known (DE-OS No. 27 20 762) to profile the slabs at the edges in such a way that they can be utilized as profiled offcuts; however, in actual practice this has failed to find general acceptance due to the difficulties involved in processing the slabs. Neither the round periphery nor the, in cross section, acute-angled and consequently inaccurate lateral edges permit a reliable guiding in planing or cutting machines. Up till now it has been cheaper to produce profiled boards for panelling purposes from the valuable cut lumber of the log heart area. The utilization of the round lumber cross section is consequently very adversely affected due to the poor utilizability of the slabs and all the more the smaller the diameter of the round lumber happens to be.

It therefore is the object of the invention to provide a method of the kind mentioned in the beginning which permits a better utilization of the slabs and particularly in the case of thin lumber being involved.

The solution according to the present invention consists in that first of all the edge profile of the slabs is formed on the round lumber and subsequently or essentially simultaneously the cuts are executed which separate the slabs from the heart planks, in which operation the round lumber is continuously conveyed in its longitudinal direction free from distortion. In a machine for carrying out this method provision has accordingly been made for a device for shaping profiled sections of the side portions in the processing line to be located in front of the saw for separating the slabs from the heart planks, whereby facilities are provided for accurately guiding the round lumber along the processing line from the profile shaping device to the saw.

It will be necessary anyway to guide the round lumber during the distribution. For this reason it is possible without extra expenditure to make provision in the round lumber processing line for a cutting device for profiling the side edges of the slabs that subsequently will be cut off. The level of the invention is based on the circumstance that thereby, according to the view held so far, the cart is put before the horse in a manner of speaking, because slabs are profiled which, at the time of the profiling operation, do not yet exist as such. Only subsequently to the profiling the slabs are separated from the heart planks. In this context it has to be said that the term heart planks in connection with the invention leaves it open whether several heart planks or only one will be cut from the heart area.

Advantageously, prior to the separation of the slabs, not only the edge profiles but also other profiles of the slabs, if provision has been made for them, are shaped while the round lumber is being guided in a distortion-free manner. In particular, thought is given in this context to a trimming of the slabs parallel to the cut which separates them from the heart planks.

Within the context of the invention it is immaterial in a first approach which facilities are used for accurately guiding the round lumber. It is possible, for instance, for guide rolls or guiding surfaces to interact with any separate guiding surfaces previously formed on the round lumber which are independent of the subsequent subdivision or profiling of the round lumber. It is most expedient, however, to use the slab profiles provided prior to the separation of the slabs from the heart planks for guiding the round lumber. That is to say, the edge profiles of the slabs are first cut and then used for guiding the round lumber. When use is made of the slab profiles for guiding the round lumber, provision is naturally made for the guiding means provided for this purpose to be located behind the facilities for shaping such profiles, and therefore between the profile cutting facilities and the saw for separating the slabs. When the profiling facilities and the saw for cutting off the slabs are arranged at a slight distance from one another and successively, it is also possible for the guiding facilities to be provided in front of the profiling facilities.

If it is a question of very thin round lumber, very frequently only one heart plank is obtained. If the diameter is greater, the heart area will frequently be divided into several planks. In such a case provision will expediently be made for a facility for accurately guiding the heart planks, which facility will interact with the surfaces formed when the slabs are cut off.

In this way a continuous processing line for round lumber is obtained in the individual stations of which, while the round lumber is continuously guided distortion-free, the following operations are carried out consecutively. First of all the slabs are profiled, then the slabs are processed as a whole and finally the heart planks are processed. It is also possible to include the cylindrical cutting of the round lumber into the same processing line. In so doing the desired profiling of the slabs is brought about without that, for this purpose, any guiding steps have to be taken which exceed the expenditure that would be incurred anyhow when the round lumber is separated. Since the slabs are produced with a clear edge profiling and, if the occasion arises, also with trimming at the top, they are also easily processed further, by way of example they may be readily planed on their plane side which was previously facing the heart of the round lumber.

In the following the invention will be described in greater detail while reference is made to the accompanying drawings which illustrated an advantageous embodiment example. In them FIGS. 1 to 6 show consecutive processing stages in cross-sectional representation of the round lumber.

Figure 2:
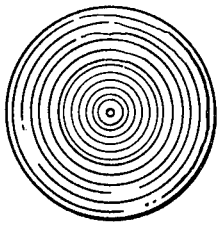
Figure 3:
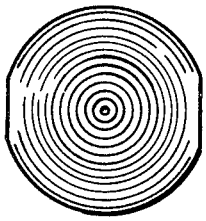

The crude round log according to FIG. 1 is, as illustrated in FIG. 2, initially cut cylindrically and exactly straight. The round log according to FIG. 2 may also be e.g. a peeled piece of round lumber. The diameter maybe within the range of 8 to 20 cm, thus in the thin wood range which has up to now not been economically utilized. During the cylindrical cutting the round lumber is rectilinearily guided and, according to FIG. 3, trimmed on the opposite sides for the duration of this guiding operation. The trimming surfaces form the top trimming of the subsequent slabs. They are rectilinear and plane and may be used as guiding surfaces.

Figure 4:
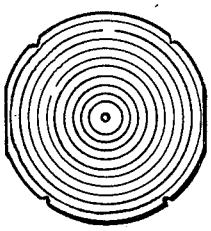
Figure 5:
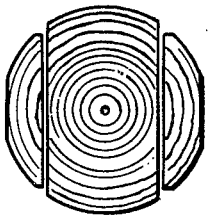
Figure 6:
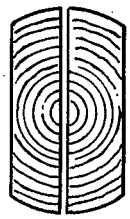

Subsequently the edge profiling of the slabs is carried out as per FIG. 4. Only following this the slabs are separated from the heart area according to FIG. 5, which area is finally separated into two heart planks according to FIG. 6.

I claim:

1. A method of producing central heart planks and peripheral slabs from logs cut into cylindrical lumber pieces, each slab of each lumber piece having in a transverse section of the lumber piece, a straight inside edge between the slab and the central heart plank, slab edge profiles inwardly of the circular profile of the round lumber piece at each end of said straight inside edge, and a circular outside surface portion adjacent each edge profile, the method comprising the steps of conveying each cylindrical lumber piece longitudinally, cutting the edge profiles of at least one slab of the cylindrical lumber piece as it is longitudinally conveyed, guiding each cylindrical lumber piece, as it is being longitudinally conveyed, with the cut edge profiles and, during said guiding step, cutting the slab along its said straight inside edge to separate it from the central heart plank of the cylindrical lumber piece.

2. A method of producing heart planks and peripheral slabs from logs cut into cylindrical lumber pieces as defined in claim 1, wherein the edge profile cutting step comprises cutting the edge profiles of a pair of diametrically opposed slabs of the cylindrical lumber piece as it is longitudinally conveyed, and wherein the slab cutting step comprises cutting the diametrically opposed slabs along their respective inside straight edges to separate them from the central heart plank of the cylindrical lumber piece.

3. A method of producing heart planks and peripheral slabs from logs cut into cylindrical lumber pieces as defined in claim 1 or 2, further comprising a trimming step prior to said slab cutting step, of trimming a flat outside surface on each slab parallel to its inside straight edge.

4. A method of producing heart planks and peripheral slabs from logs cut into cylindrical lumber pieces as defined in claim 1 or 2, further comprising the steps of conveying the central heart plank longitudinally while longitudinally guiding it with the straight edge thereof provided by the slab cutting step, and during said heart plank conveying step, cutting the central heart plank into at least two heart plank pieces.

* * * * *